US005846127A

United States Patent [19]

Kile

[11] Patent Number: 5,846,127

[45] Date of Patent: Dec. 8, 1998

[54] APPARATUS FOR VENTING

[76] Inventor: Walter F. Kile, Box 77, Zion Hill, Pa. 18981

[21] Appl. No.: 985,157

[22] Filed: Dec. 4, 1997

[51] Int. Cl.[6] ..... E06B 7/02

[52] U.S. Cl. ..... 454/195; 454/256

[58] Field of Search ..... 454/195, 256, 454/258; 160/118, 35

[56] References Cited

U.S. PATENT DOCUMENTS 4,460,030 7/1984 Tsunemura et al. ..... 160/35

4,574,860 3/1986 Weiss ..... 160/118

4,754,524 7/1988 Bullock et al. ..... 16/273

5,531,490 7/1996 Parker ..... 292/262

*Primary Examiner*—Harold Joyce

*Assistant Examiner*—Derek S. Boles

*Attorney, Agent, or Firm*—Zachary T. Wobensmith, III

[57] ABSTRACT

Apparatus for venting, which is used with a door such as a sectional garage door, which permits the top door section to pivot inwardly a controlled distance, by a mechanical opener or an electrically controlled solenoid opener, which permits venting of a space.

9 Claims, 8 Drawing Sheets

119
16

118
112
17
116
14
65A
105
114
26
115
46
25
45
25A
110
27
30
15
54
51
111
12
51A
112
14
102
101
18

APPARATUS FOR VENTING

BACKGROUND OF THE INVENTION

1. Field of the Invention

This invention relates to apparatus for venting a space, of the type which is used with a sectional door, whereby the top door section is pivoted inwardly by a manual or electric opener.

2. Description of the Prior Art

Garages are typically used for the storage of cars, lawn mowers, tractors, paint, cleaning and other volatile solvents, with the build up of fumes in the space from these items being highly undesirable.

The typical solution for the temporary venting of a space such as a garage, which has one or more vertically movable sectional doors, has been to partially raise and then block open the door. Raising the door however can result in the entry of undesirable animals, the escape of pets from the space, introduces an element of risk, and reduces the security of the space.

While raising the door may result in the entry of outside air at the bottom, there is no assurance that the fumes inside will be carried out of the space at the top.

The apparatus for venting does not compromise the security of the space, allows fresh air to circulate throughout the space, and undesired fumes to be carried out of the space, without alterations to the existing doors, and works with the doors locked and secured in the down position.

SUMMARY OF THE INVENTION

This invention relates to apparatus for venting a space, which is useful with a sectional door, and which permits the top section of the door to pivot inwardly a controlled amount, and which has a manual or electrically controlled opener.

The principal object of the invention is to provide apparatus for venting a space, which permits the top section of a vertically movable sectional door to pivot inwardly, while the door is locked and secured.

A further object of the invention is to provide apparatus for venting that uses the existing door hardware.

A further object of the invention is to provide apparatus for venting that is easily and quickly installed.

A further object of the invention is to provide apparatus for venting that maintains the security of the space.

A further object of the invention is to provide apparatus for venting whose operation is manually or electrically controlled.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
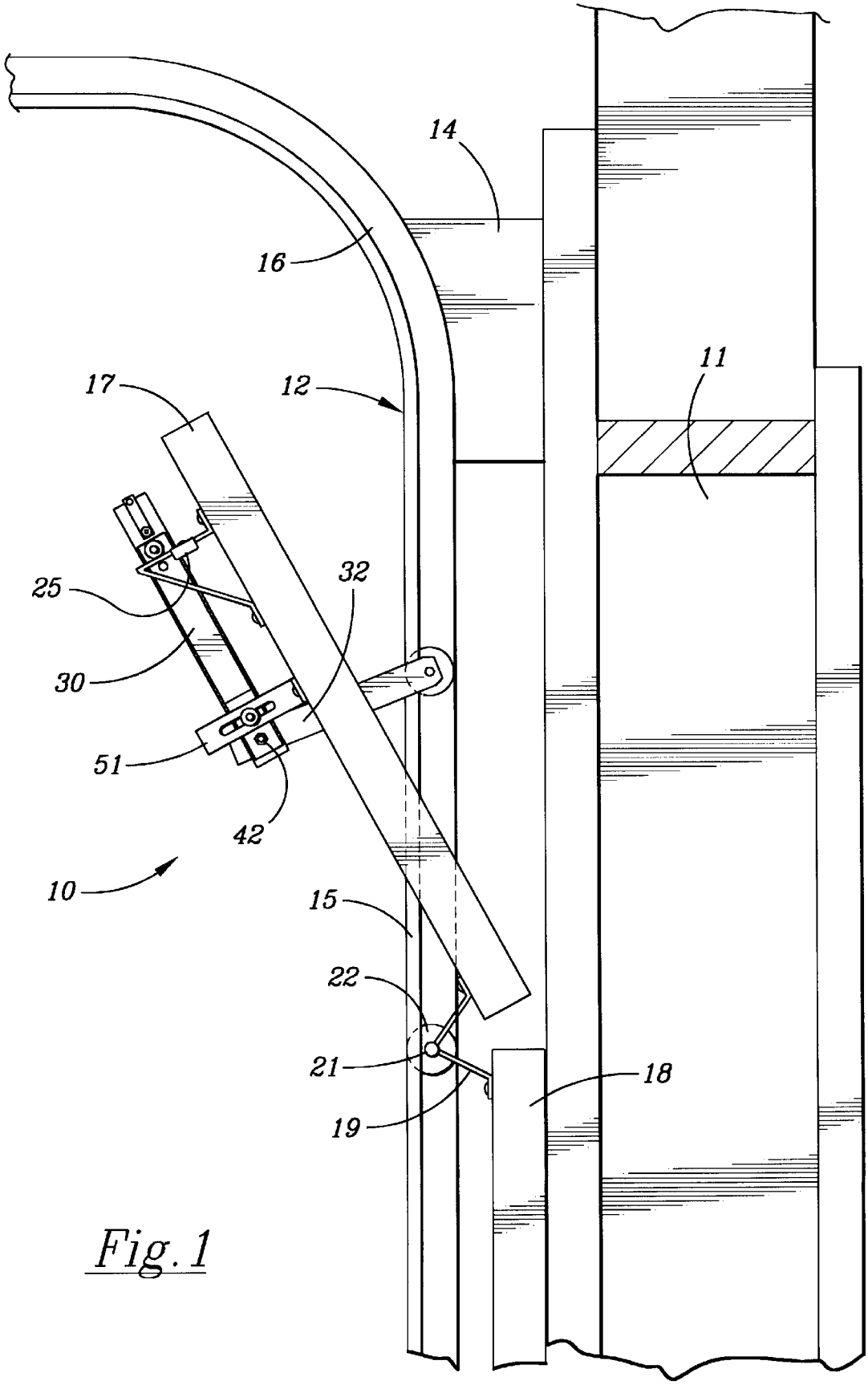
FIG. 1 is a fragmentary, side elevational view, showing one embodiment of the apparatus for venting, in place on a door section in unlocked position.
Figure 2:
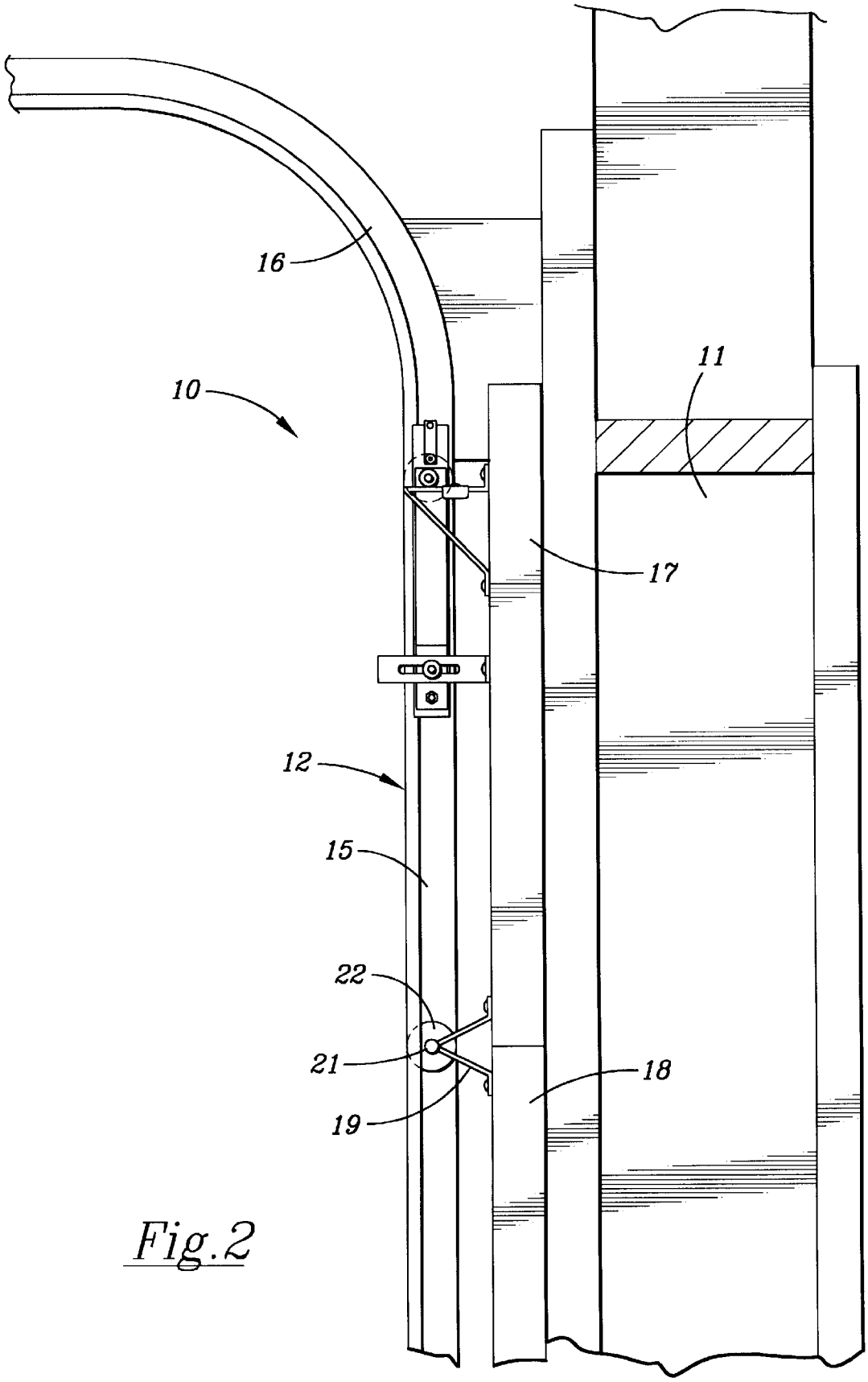
FIG. 2 is a view similar to FIG. 1 showing the door section in closed locked position.
Figure 3:
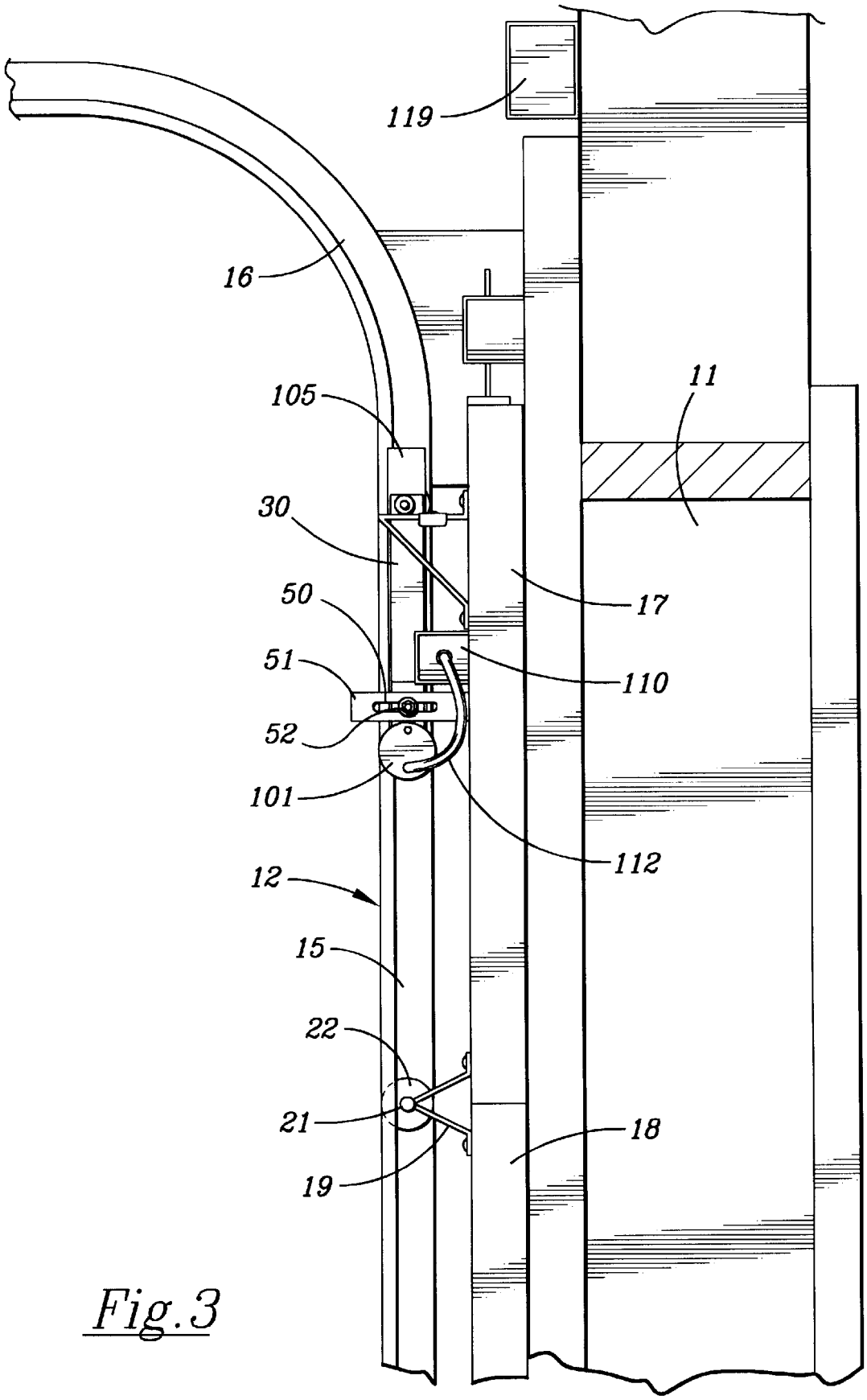
FIG. 3 is a side elevational view, in partial section, of another embodiment of the invention illustrating the electrically controlled version.
Figure 4:
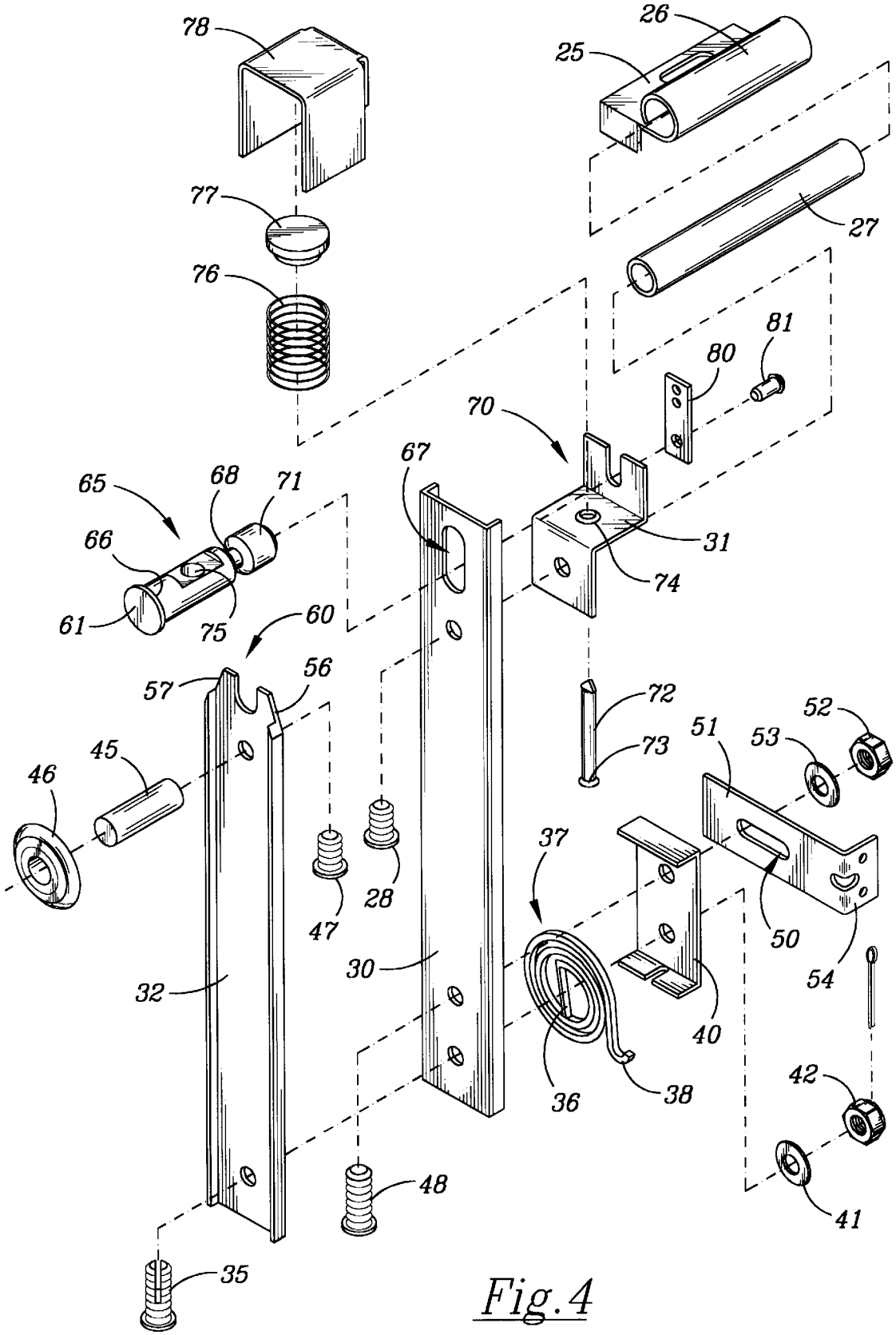
FIG. 4 is an exploded, perspective view, of the embodiment of the apparatus of FIG. 1 of the invention.
Figure 5:
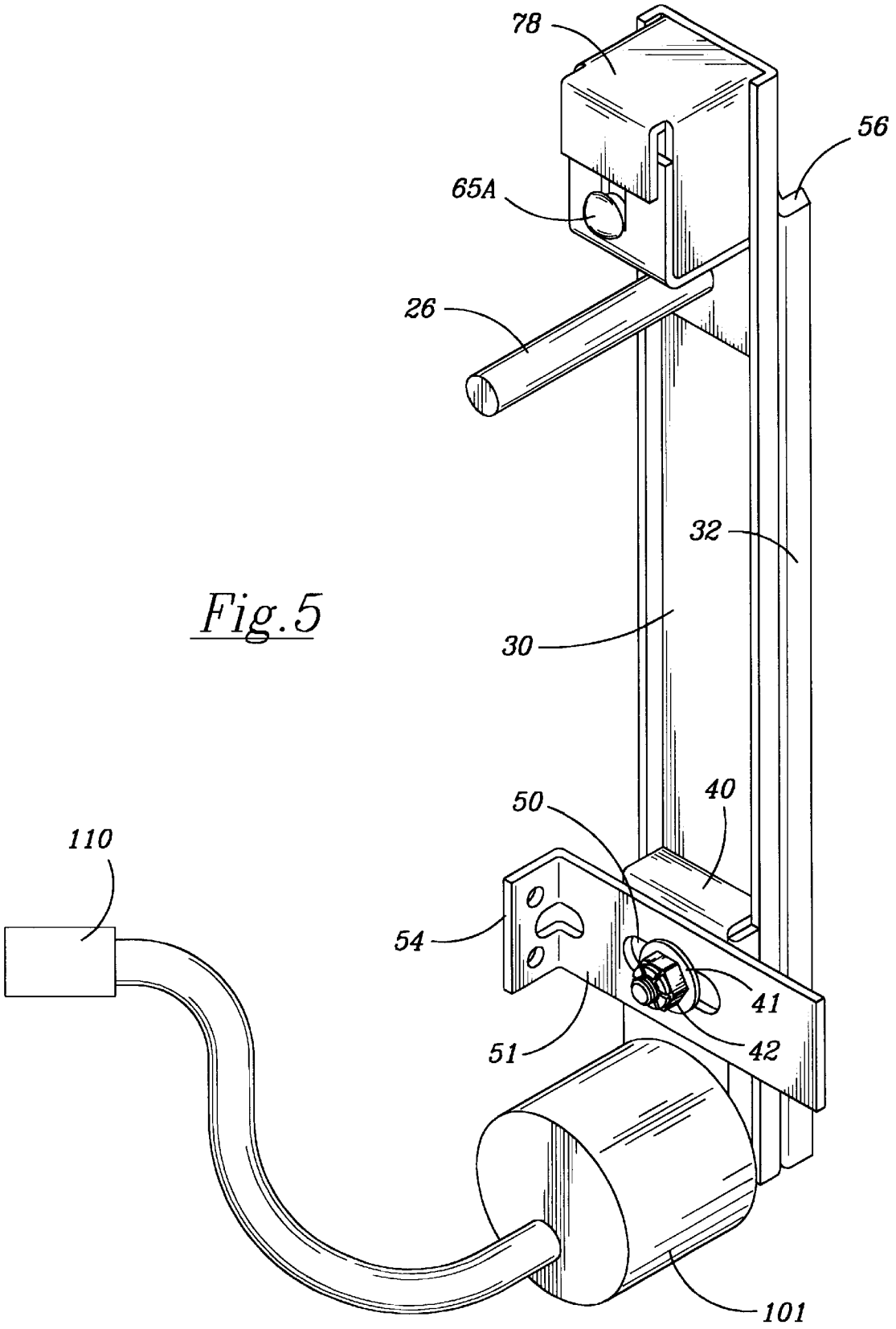
FIG. 5 is a perspective view of the electrically controlled embodiment of the invention.
Figure 6:
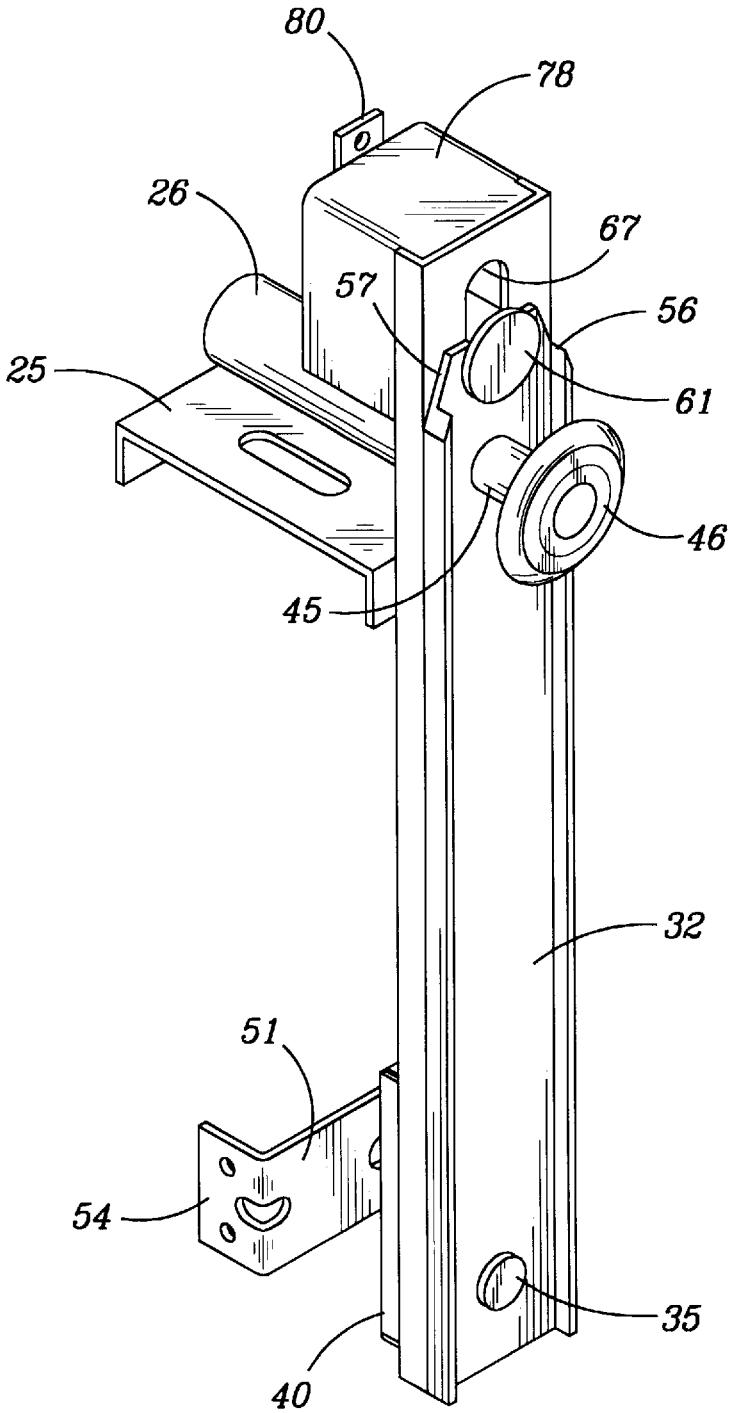
FIG. 6 is a perspective view of the apparatus of FIG. 4 in assembled locked condition.

It should, of course, be understood that the description and drawings herein are merely illustrative and that various modification and changes can be made in the structures disclosed without departing from the spirit of the invention.

Like numeral refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1,2,4, and 6 of the drawings, one embodiment 10 of the apparatus for venting is therein illustrated,whose opening is mechanically controlled.

A door jam 11 is shown which has tracks 12 attached thereto by integral brackets 14. The tracks 12 are of conventional well known type, with straight sections 15 and curved sections 16.

A door is illustrated which includes a plurality of door sections, with a top door section 17, and similiar door sections 18 attached thereto by a hinge 19 on each side, and screws (not shown) in well known manner. The hinges 19 have housings (not shown) with axle pins 21 carried therein, which have rollers 22 fastened thereto, which rollers are carried in the tracks 12 to control the movement of the door sections 17 and 18.

The venting apparatus 10 includes a door axle bracket 25, of triangular shape in cross section, which is mounted to top door section 17 adjacent the curved portion 16 of track 12 by screws (not shown). The bracket 25 which is of metal, has a door axle socket 26 fastened thereto with a door axle 27 carried therein.

The door axle 27 is engaged with a press fit bolt 28 (PEM) which extends through an opening 29 in a door link 30 retaining the axle thereto. The door link 30 is of metal, of retangular configuration, with a lock pin bracket 31 between the bolt 28 and door link 30.

The door link 30 at the end opposite to the door axle 27 is pivotally secured to a track link 32, by a slotted pivot pin 35 which has one end 36 of a clock type return spring 37 engaged therewith, with the springs' other end 38 engaged and carried in a spring retainer housing 40 on the opposite side of the door link 30, with a washer 41 on pin 35 and a slotted retaining nut 42 thereon, which can have a cotter pin (not shown)inserted therethrough after assembly,such that the spring 37 urges the door link 30 and the track link 32 to a parallel position.

The track link 32 is of metal, of rectangular configuration, with a roller axle 45 extending from the link 32 at its end opposite to pivot pin 35, with a roller 46 attached thereto and with the axle 45 retained to link 32 by a press fit bolt 47 (PEM). The roller 46 rotates about axle 45 and is carried in track 12.

The spring retainer housing 40 has a bolt 48 (PEM) extending therefrom, through opening 49 in housing 40, which bolt extends through slot 50 in a stabilizer bracket 51 and is retained therein by nut 52 and washer 53. The stabilizer bracket 51 is of metal, of L shape with a plate 54 attached to the top door section 17 by screws (not shown).

The track link 32 at its end adjacent the roller axle 45 has upwardly extending tapered walls 56 and 57, with a slot 60 therebetween.

The slot 60 has one end 61 of a lock pin 65 selectively engaged therewith.

The end 61 of lock pin 65 is of circular shape with a tapered shoulder 66, and the lock pin extends through a slot 67 in door link 30 with a groove 68 therein which is engaged in a slot 70 in lock pin bracket 31, with an end 71 of larger diameter than slot 70.

The lock pin 65 is retained by an upwardly extending spring assembly pin 72 which has its lower end 73 engaged in a coined dimple 74 in bracket 31, which restrains its upward movement and permits the pin 72 to swivel. The pin 72 extends through an opening 75 in lock pin 65 with a spring 76 engaged therewith and which is retained thereon by a spring retainer 77. The combination of pin 72 and spring 76 permits the lock pin 65 to move upwardly in slot 67 and out of slot 60 so that the track link 32 can pivot about pin 35 to be described.

The lock pin 65 at end 71 is provided with an arm 80 which is secured thereto by screw 81 with a cable (not shown) attached thereto which can be pulled to cause pin 65 to tilt, and end 61 to move up out of slot 60 so that track link 32 is unlocked, and can pivot about pin 35.

A spring assembly housing 78 is provided which snaps over lock pin bracket 31 to protect the lock pin 65.

Referring additionally to FIGS. 3,5,7 and 8 another embodiment 100 of apparatus for venting is therein illustrated, which has an electronically controlled opener.

The apparatus 100 is similiar to apparatus 10 in that it includes a door jam 11 which has a track 12 attached thereto by integral brackets 14. The track 12 is of conventional well known type, with a straight section 15 and a curved section 16.

A door is illustrated which includes a plurality of door sections, with a top door section 17, and similiar door sections 18 attached thereto by a hinge 19 on each side, and screws 20 in well known manner. The hinges 19 have housings (not shown) with axle pins 21 carried therein, which have rollers 22 fastened thereto, which rollers are carried in the tracks 12 to control the movement of the door sections 17 and 18.

The venting apparatus 100 includes a door axle bracket 25, which is mounted to top door section 17 adjacent the curved portion 16 of track 12 by bolts 25A. The bracket 25, which is of metal, has a door axle socket 26 fastened thereto, with a door axle 27 carried therein.

The door axle 27 is engaged with a press fit bolt 28 (PEM) which extends through an opening (not shown) in a door link 30 retaining the axle thereto. The door link 30 is of metal, is of retangular configuration, with a lock pin bracket 31 between the bolt 28 and door link 30.

The door link 30 at the end opposite to the door axle 27 is pivotally secured to a track link 32, by a shaft (not shown), of a motor 101 of well known type, which has a limit switch 102, which motor controls the pivotal movement of link 32 about link 30.

The track link 32 is of metal, of rectangular configuration, with a roller axle 45 extending from the link 32 at its end opposite to motor 101, with a roller 46 attached thereto and with the axle 45 retained in link 32 by a press fit bolt (PEM) (not shown). The roller 46 rotates about axle 45 and is carried in track 12.

The link 30 has a bolt (PEM) extending therefrom, through a slot 50 in a stabilizer bracket 51 and is retained therein by nut 52 and washer 53. The stabilizer bracket 51 is of metal, of L shape with a plate 54 attached to the top door section 17 by screws 51A.

The track link 32 at its end adjacent the roller axle 45 has upwardly extending tapered walls (not shown), with a slot 60 therebetween.

The slot 60 has one end (not shown) of a lock pin 65A selectively engaged therewith.

The end (not shown) of lock pin 65A is of circular shape with a tapered shoulder (not shown) and the lock pin extends and is connected to an electrically controlled solenoid 105 which is attached to door link 30 in well known manner, such as by screws (not shown).

Figure 8:
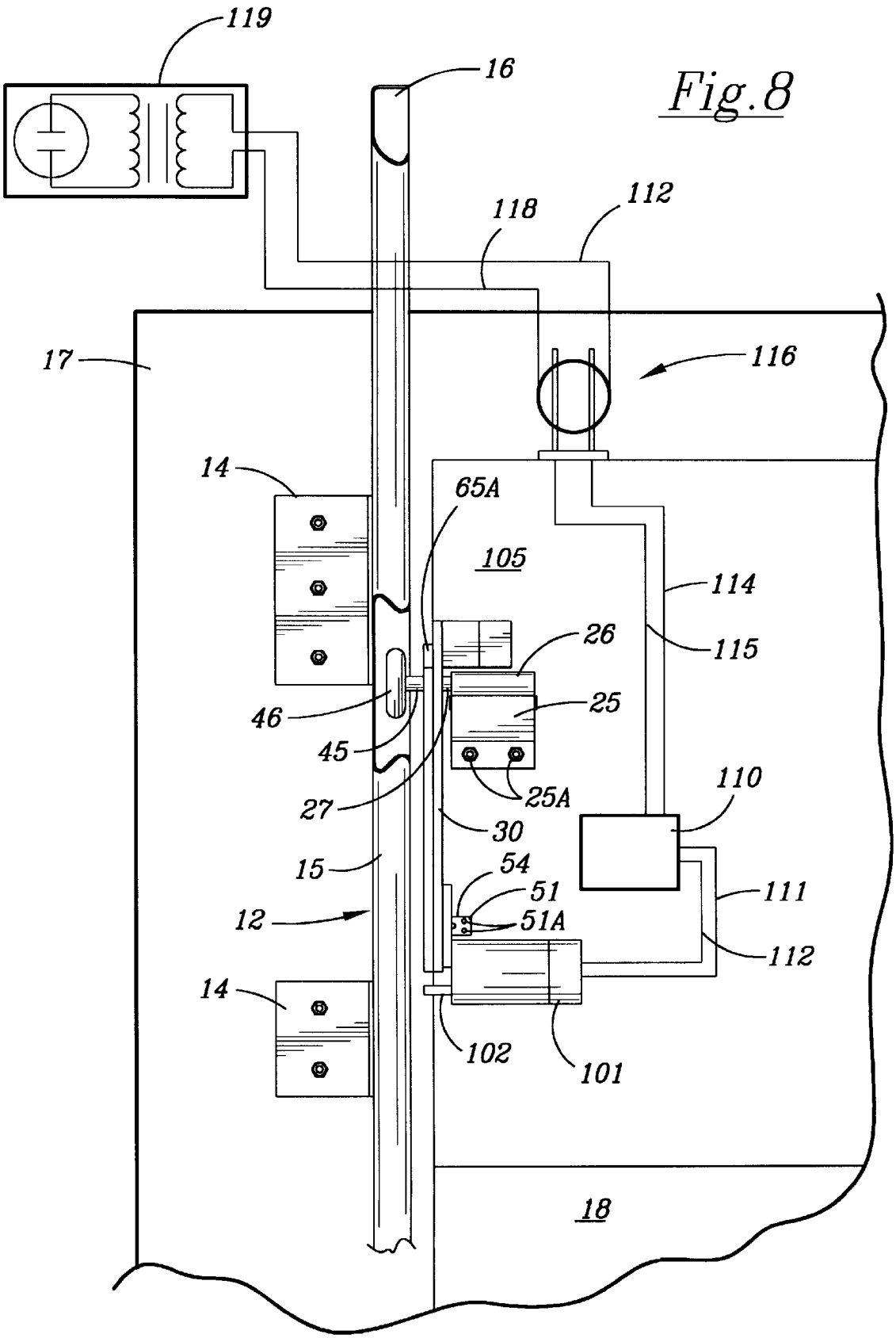
FIG. 8 is a front elevational view; enlarged, of the electrically controlled embodiment of the invention.

The preferred circuit embodiment, for controlling the apparatus 100 is illustrated in FIG. 8, and includes a controller 110 connected to a motor 101 by wires 111 and 112 to control the rotation of the motor 101 output shaft (not shown), to determine the pivotal movement of link 30 respective to link 32 to permit door section 17 to tilt inwardly, and to be returned to locked position.

The controller 110 is of well known type and connected by wires 114 and 115 to a power input device 116 which is connected by wires 117 and 118 to a transformer 119, which is connected to a source of electrical power (not shown).

The solenoid 105 is connected by wires 120, 121 to the power input device 116 which controls its operation.

Figure 7:
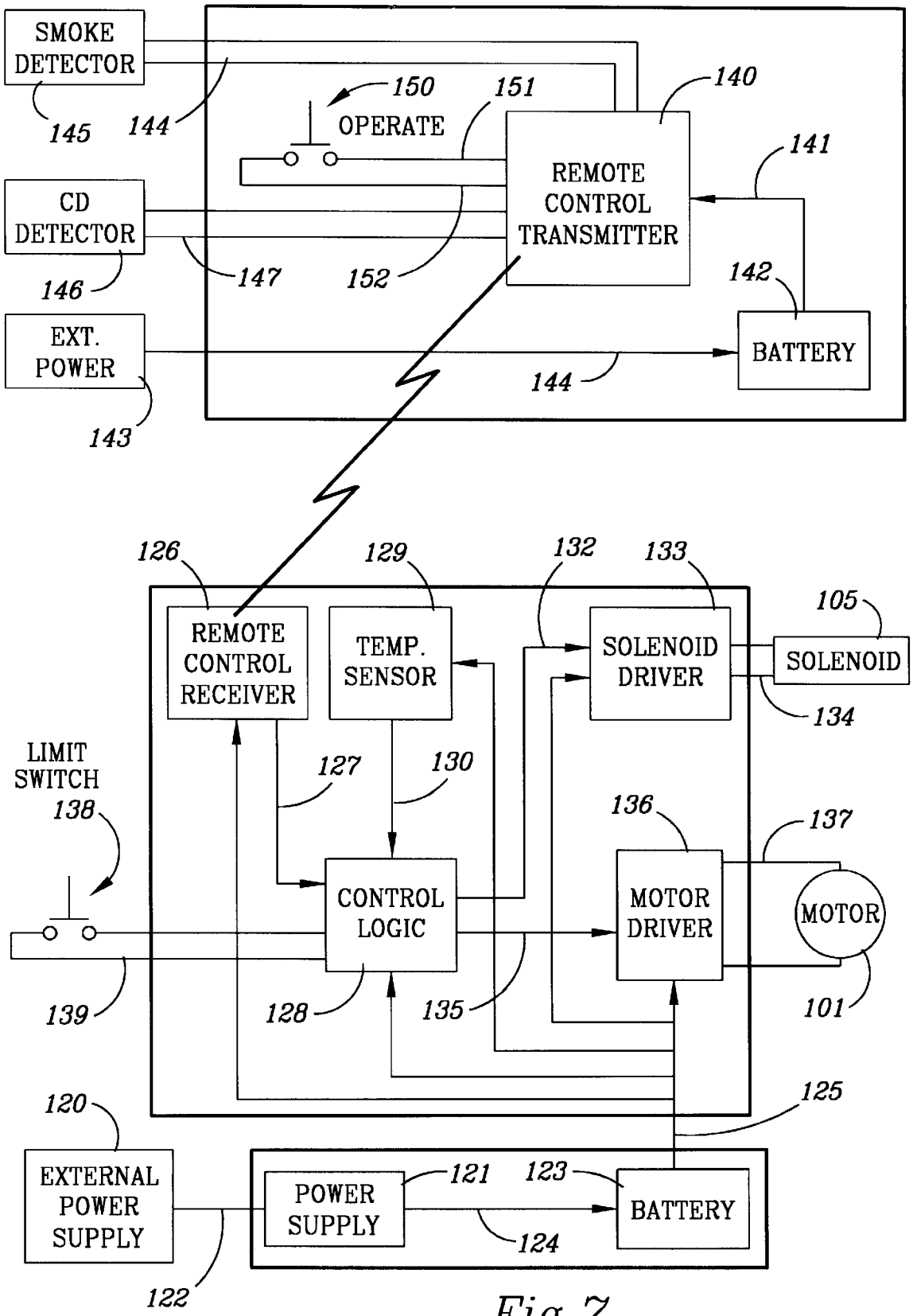
FIG. 7 is an electrical schematic diagram of one embodiment of circuit used with the electrically controlled embodiment of the invention.

Referring additionally to FIG. 7 another circuit embodiment which is used to control the motor 101 and solenoid 105 is therein illustrated. In this circuit provision has been made to control the opening and closing operation of top door section 17 in accordance with the measured temperature, by a carbon monoxide detector and/or a smoke detector.

The circuit includes an external power input 120 connected to a power supply 121 by cable 122, which power supply is connected to a battery 123 by cable 124.

The battery 123 is connected by cable 125 to a remote control receiver 126 which is of the type that can activated by radio frequency such as that emitted by any well known radio frequency transmitter, to be described.

The receiver 126 is connected by cable 127 to a control logic 128, which is also connected to cable 125. A temperature sensor 129 is provided connected to cable 125 and by cable 130 to control logic 128.

The control logic 128 of well known type receives inputs from the temperature sensor 129, and is connected by a cable 132 to a solenoid driver 133, which is also connected to cable 125 from battery 123, and to the solenoid 105 by cable 134 to control its operation.

The control logic 128 is connected by cable 135 to a motor driver 136 of well known type, which is connected by cable 137 to motor 101 to control its operation.

The control logic is connected to limit switch 138 through cable 139.

A remote control transmitter 140 is shown which can be any well known radio frequency transmitter which transmits signals to control the operation of the remote control transmitter 126, which in turn controls the operation of motor 101 and the position of top door section 17.

The remote control transmitter 140 is connected by cable 141 to battery 142 which is connected to an external power supply 143 by cable 144. A smoke detector 145 is provided of well known type connected by cable 146 to transmitter 140. A carbon monoxide (CO) detector 146 is provided, of well known type, connected to transmitter 140 by cable 147.

An operating switch 150 is provided connected to transmitter 140 by cables 151, 152.

The mode of operation will now be pointed out.

For the mechanical embodiment of the apparatus 10, when it is desired to tilt top door section 17 inwardly, arm 80 is pulled by the cable (not shown) attached thereto which causes lock pin 65 to tilt about spring assembly pin 72 moving end 61 out of slot 60 in track link 32 unlocking it from door link 30.

Door section 17 is urged downwardly by gravity and inwardly, pivoting on hinges 19 with door link 30 pivoting about pin 35, moving track link 32 downwardly, thereby moving roller 46 downwardly in track 12 until it is fully extended which halts pivoting of door section 17, which is in its fully open position.

When it is desired to close door section 17 it is pushed toward the door jam 11 until the end 61 of lock pin 65 contacts wall 57 whereby pin 65 pivots about pin 72, and the tapered end 61 engages slot 60 of track link 32 and groove 68 is engaged therewith locking links 30 and 32.

Arm 80 can again be tilted and the operation resume.

If the electrically controlled apparatus 100 is installed the circuitry shown in FIG.7 can also be employed where the opening is controlled by the measured temperature or detected smoke, or carbon monoxide and which may be by in the space to be vented and which may be by radio frequency input to the remote control receiver.

The circuitry shown in FIG. 8 can also be employed. When tilting of top door section 17 is desired power input device 116 is activated which causes solenoid 105 to operate and lock pin 65A to be tilted up out of slot 60 whereby links 30 and 32 are unlocked.

Motor 101 is actuated and door link 30 is pivoted about the shaft (not shown) from motor 101 until it reaches the desired open position, or trips limit switch 102 whereby motor 101 is stopped.

When it is desired to close door section 17, motor 101 is actuated to cause link 30 to pivot in the opposite direction towards door jam 11, which causes end 61A of lock pin 65A to be engaged by shoulder 56 of track link 32 until pin 65A is in slot 60 thereby locking links 30 and 32 together.

The operation can continue as desired.

It will thus be seen that apparatus has been provided with which the objects of the invention are achieved.

I claim:

1. Apparatus for venting a space which has at least one door opening which is closed off by at least one vertically movable sectional door mounted in vertical tracks, which door includes a top door section and additional door sections connected thereto by hinges, the door sections having housings carried by the doors with axle shafts in the housings carrying rollers which are engaged in the tracks to control the movement of the door sections, the improvement which comprises said top door section having a pair of door axle brackets mounted thereto adjacent said tracks, each of which includes a door axle carried in said bracket, a door link attached to said door axle, a stabilizer bracket attached to said door link and said top door section, a track link connected by pivot means at one end to said door link, a roller axle carried by said track link, a roller carried by said axle and rotatable thereabout, said roller being engaged in one of said tracks, said pivot means including means for urging said track links to a upright position in parallel with said door link, and latching means for locking said links at their ends opposite to said pivot means, whereby upon unlocking of said latching means said links pivot at said pivot means to permit said top door section to swing inwardly.

2. Apparatus for venting as defined in claim 1 in which said pivot means includes a slotted pivot pin connecting said links, said slotted pivot pin being fixedly retained in said track link, a spring retainer housing connected to said stabilizer bracket, said means for urging includes a spring having one end in said pivot pin slot, and the other end engaged with said spring housing urging said track link to an upright parallel position with said door link.

3. Apparatus for venting as defined in claim 1 in which said pivot means includes an electric motor carried by said door link, a shaft extending from said motor and fixedly engaged with said track link, and motor control means to control the rotation of said motor shaft, the relative position of said links, and the position of said top door section.

4. Apparatus for venting as defined in claim 1 in which said latching means includes an open slot in said track link at the end opposite to said pivot means, a slot in said door link, a lock pin bracket carried by said door link, a lock pin having one end engaged with said lock pin bracket, said lock pin extending through said door link slot and being detachably engageable with said track link slot for locking, said bracket having a spring assembly pin engaged therewith, said spring assembly pin engaged with said lock pin, spring means engaged with said lock pin and said spring assembly pin above said lock pin, urging said lock pin into engagement with said track link slot, and arm means connected to said lock pin whereby said lock pin may be pivoted about said spring assembly pin to raise its end in said door link slot out of engagement with said track link slot for unlocking.

5. Apparatus for venting as defined in claim 3 in which said latching means includes an open slot in said track link at the end opposite to said pivot means, a slot in said door link, a lock pin bracket carried by said door link, an electricaly actuated solenoid mounted to said bracket, control means to control the operation of said solenoid, a lock pin having one end engaged with said solenoid, said lock pin extending through said door link slot and being detachably engageable with said track link slot for locking, said bracket having a spring assembly pin engaged therewith, said spring assembly pin engaged with said lock pin, spring means engaged with said lock pin and said spring assembly pin above said lock pin, urging said lock pin into engagement with said track link slot, whereby upon operation of said solenoid said lock pin may be pivoted about said spring assembly pin to raise its end in said door link slot out of engagement with said track link slot for unlocking.

6. Apparatus for venting as defined in claim 5 in which remote control means are provided to control said solenoid control means and said remote control means;

said remote control means includes a control logic;

a remote control receiver connected to said control logic to provide inputs to said solenoid and said motor control means, and remote control transmitter means to provide control signal inputs to said remote control receiver.

7. Apparatus for venting as defined in claim 6 in which said remote control transmitter means includes smoke detector means to activate said transmitter.

8. Apparatus for venting as defined in claim 6 in which temperature sensing means are provided connected to said control logic to provide inputs based on measured temperatures.

9. Apparatus for venting as defined in claim 6 in which said remote control means includes carbon monoxide means to activate said transmitter.

* * * * *